United States Patent [19]

Asami et al.

[11] 4,173,232

[45] Nov. 6, 1979

[54] RESIDUAL COIN DETECTING DEVICE IN COIN PROCESSING MACHINE

[75] Inventors: Kazuto Asami; Takashi Okamoto, both of Himeji, Japan

[73] Assignee: Glory Kogyo Kabushiki Kaisha, Hyogo, Japan

[21] Appl. No.: 882,038

[22] Filed: Feb. 28, 1978

[51] Int. Cl.[2] ..... G07D 3/00

[52] U.S. Cl. ..... 133/3 R; 133/8 R

[58] Field of Search ..... 133/1 R, 3 R, 3 A, 3 H, 133/8 R

[56] References Cited

U.S. PATENT DOCUMENTS

| | | | |
|---|---|---|---|
| 3,991,778 | 11/1976 | Ushio et al. | 133/8 R |
| 3,998,237 | 12/1976 | Kressin et al. | 133/3 A |
| 4,092,990 | 6/1978 | Bayne | 133/1 R |
| 4,126,146 | 11/1978 | Ozaki | 133/3 A |

*Primary Examiner*—Joseph J. Rolla

*Attorney, Agent, or Firm*—Beveridge, DeGrandi, Kline & Lunsford

[57] ABSTRACT

In a coin processing machine wherein coins from a turntable are sent in succession through a coin passageway to a processing position, a pair of coin guides at least one of which is adjustable by a first control member are arranged on opposite sides of the coin passageway thus defining the width variable of the coin passageway, a residual coin detecting device comprises an electric driving unit driving the first control member and also a second control member in accordance with a selected one of a plurality of selectable denominations of coins set in the machine, and a residual coin detecting member controlled by the second control member in vertical movements between the coin guides prior to the adjustment of the movable coin guide by the first control member, so that coins incidentally remaining in the coin passageway are detected by the coin detecting member.

11 Claims, 5 Drawing Figures

RESIDUAL COIN DETECTING DEVICE IN COIN PROCESSING MACHINE

BACKGROUND

This invention relates generally to coin handling and processing apparatuses and particularly to coin processing machines of the type in which the width of a coin passageway, into which coins from coin feeding means are supplied in succession, is adjusted in accordance with a selected kind of coin to be processed thereby to discriminately pass only the coins of the selected kind, which are then counted.

More specifically, this invention relates to a residual coin detecting device which, in a coin processing machine of the above stated type, detects whether or not any residual coins are remaining in the coin passageway.

Coin processing machines are classified broadly into an automatic type and a manually processing type. In the latter type machine, the operator manually rotates a turntable so as to process or count coins while observing the flow of the coins. Thus, in the case where the width of the coin passageway is to be changed in accordance with the kind of the coins, the presence or absence of coins in the coin passageway can be easily detected.

However, in the automatic coin processing machine of a conventional type, if the setting for the coin denomination to be processed is to be changed, the width of the passageway is also changed automatically. If a residual coin detecting device is not provided in the machine, not only the coins but also the coin passageway and the associated parts are apt to be damaged at the time the width of the coin passageway is automatically changed while coins are remaining in the coin passageway.

SUMMARY OF THE INVENTION

A primary object of the present invention is to provide a residual coin detecting device which is adapted to be incorporated in the type of coin processing machine having a coin passageway adjustable in accordance with the kind of coins to be processed, and which is capable of detecting those coins incidentally remaining in the coin passageway.

Another object of the invention is to provide a residual coin detecting device which is simple in construction and can be easily manufactured.

Still another object of the invention is to proide a residual coin detecting device which can be intercoupled with a coin denomination setting mechanism of the coin processing machine for detecting residual coins prior to the width adjustment of the coin passageway.

These and other objects, which will be made apparent in the following detailed description of the invention, can be achieved by a residual coin detecting device adapted to be used in a coin processing machine wherein coins to be processed are supplied into a turntable and thereafter fed in succession through a coin passageway extending from the periphery of the turntable, and the width of the coin passageway defined by a pair of coin guides can be adjusted in accordance with the diameter of coins by adjusting at least one of said pair of coin guides, a control member being provided for engagement with the movable coin guide, the residual coin detecting device comprising electrical driving means selectively operable for bringing the control member to a predetermined position in accordance with a signal from a coin denomination setting section of the coin processing machine and a residual coin detecting member also driven, prior to the movement of the movable coin guide, by the electrical driving means, vertically in between the coin guides, so that coins incidentally remaining in the coin passageway can be detected by the coin detecting member.

Advantageously, another control member may be further provided in the residual coin detecting device in a manner such that the second control member is also driven by the electrical driving means and is coupled to the residual coin detecting member.

In order that the residual coin detecting member be lowered in between the coin guides far beyond an ordinary coin thickness defining position prior to the initiation of the coin denomination setting operation of the machine, a specially formed part may be provided on the second control member, or, otherwise, a separate solenoid means which disconnects the detecting member from the control of the second control member and lowers the same to the extreme lower position may be provided.

The invention will be more clearly understood from the following detailed description of the invention when read in conjunction with the accompanying drawings.

DETAILED DESCRIPTION

Figure 1:
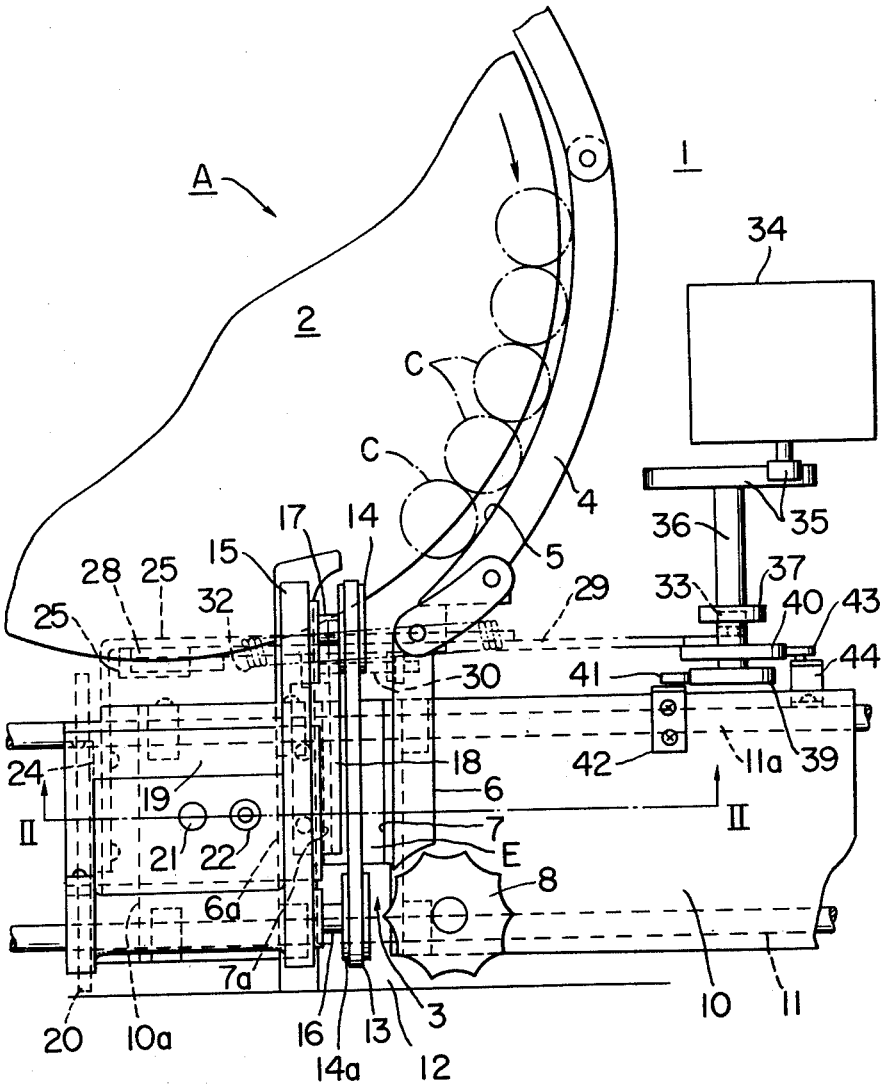
FIG. 1 is a partial plan view showing a residual coin detecting device which constitutes a first embodiment of the present invention.
Figure 2:
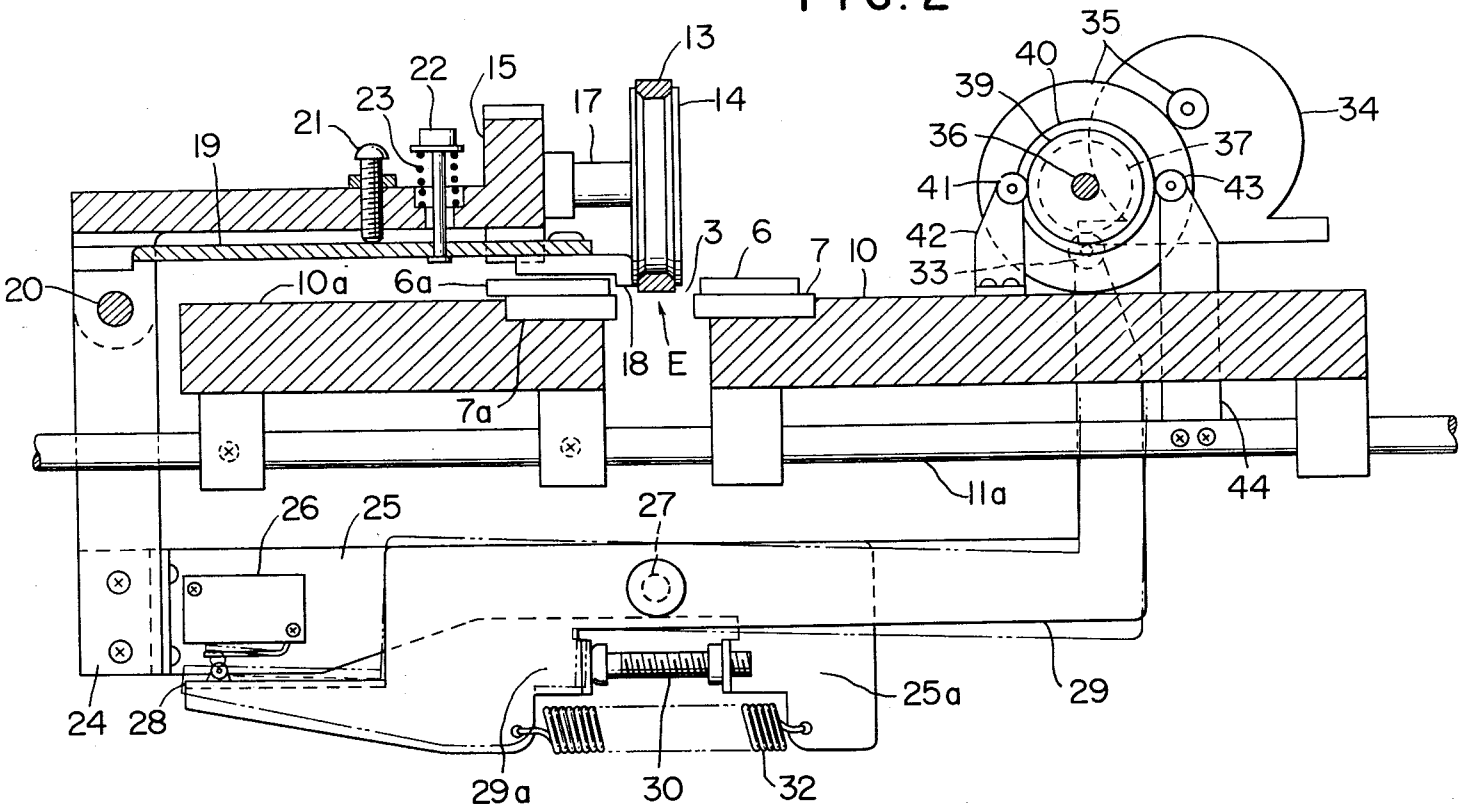
FIG. 2 is a vertical sectional view taken along the line II—II of FIG. 1 as viewed in the arrow direction.
Figure 3:
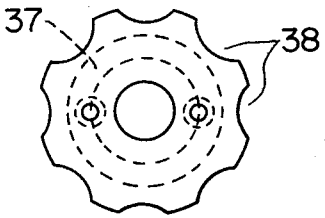
FIG. 3 is an elevation of a height adjusting cam used in the first embodiment.

Referring now to FIGS. 1, 2, and 3 showing a first embodiment of the present invention, a turntable 2 rotatable in a horizontal plane in the arrow direction by the driving power of an electric motor (not shown) is mounted on a machine frame 1 of a coin counting machine A, and a coin passageway 3 extends away from a peripheral point of the turntable 2 at the same height level as the turntable 2.

Coins C to be processed are supplied onto the turntable 2, moved outwardly by the centrifugal force caused by the rotation of the turntable 2 toward the peripheral part thereof, and are brought into contact against the guiding edge 5 of a guide rail 4 to be guided thereafter into the coin passageway.

The coin passageway 3 comprises a coin guiding plate 6 swingably connected to the coin guiding rail 4 for guiding the coins sent into the passageway 3 on one lateral side thereof, another coin guiding plate 6*a* for guiding the coins passing through the coin passageway 3 on the other lateral side thereof, and coin selecting plates 7 and 7*a* fixed respectively to the lower surfaces of the coin guiding plates 6 and 6*a* for forming therebetween a coin dropping port E through which coins having smaller diameters than those coins to be processed are dropped downward. Downstream of the coin passageway 3, there is provided a coin counting wheel 8 of a star shape, which is engaged by the coins passing through the coin passageway 3 and thus turned by each coin through a specific angle.

The coin guiding plates 6 and 6a are fixed respectively to movable base plates 10 and 10a, the positions of which are adjustable in accordance with the diameter of the coins to be processed. The movable base plates 10 and 10a are supported, as hereinafter described in more detail, by parallel guide bars 11 and 11a which extend transversely relative to the machine frame with a spaced-apart relation. The above mentioned coin selecting plates 7 and 7a are secured to the inward edges opposed to each other of the movable base plates 10 and 10a.

Above the coin passageway, there is provided a coin propelling belt 13 which is stretched around a pair of pulleys 14 and 14a and is brought into contact with the upper surfaces of the coins fed along the coin guiding rail 4 into the coin passageway 3, so that the coins are thereby propelled toward a coin delivering position. A shaft 16 integral with the pulley 14a and another shaft 17 integral with the pulley 14 are both rotatably supported by a pulley supporting frame 15, and the shaft 16 is driven by a driving motor (not shown).

According to the present invention, a coin rise preventing plate 18 is further provided above the coin passageway 3 in a state parallel to and spaced slightly apart from the coin propelling belt 13 and extending along the length of the coin passageway 3. In the entire coin passageway 3, the plate 18 prevents the coins passing therethrough from rising upward out of the passageway.

The coin rise preventing plate 18, which is also operable as a member to detect residual coins, as described hereinafter in more detail, is so adapted that it is movable vertically in the space between the coin classification plates 7 and 7a and is adjustable in accordance with the thickness of the coins under the control of a mechanism shown in FIG. 2.

More specifically, the mechanism includes a cam 37 providing a vertical displacement which is transmitted through a first arm 25 and a second arm 29 to a supporting plate 19 swingable around a horizontal pivot shaft 20, and the coin rise preventing plate 18 secured to an end of the supporting plate 19 is thereby displaced vertically in between the coin classification plates 7 and 7a.

Still more specifically, the coin rise preventing plate 18 is secured to the supporting plate 19 provided below the supporting frame 15. The supporting frame 15 and the supporting plate 19 are both swingably supported by the shaft 20 provided on the machine frame 1, so that the free ends of these members are movable up and down relative to the coin passageway 3.

An interval adjusting screw 21 having one end to be brought into contact with the supporting plate 19 is driven through the supporting frame 15. A suspension pin 22 secured at its lower end to the supporting plate 19 extends through a loose hole in the supporting frame 15, and a compression spring 23 is inserted around the suspension pin 22 between the supporting frame 15 and an enlarged head part of the pin 22, so that the supporting plate 19 is urged against the lower end of the interval adjusting screw 21. The gap between the supporting plate 19 and the supporting frame 15 can thus be adjusted by turning the screw 21.

The end of the supporting plate 19 on the far side from the coin rise preventing plate 18 is secured to the upper end of a bracket 24 swingable around the pin 20, and the first arm 25 is secured to the lower part of the bracket 24. The first arm 25 has an L-shaped end part 25a, and is pivotally connected at its intermediate part with the second arm 29 through a pivot pin 27.

Between the L-shaped end part 25a and the knee part 29a of the second arm 29, an adjusting screw 30 for adjusting the interval and a tension spring 32 for tensioning the two parts together are provided. The first arm 25 can thus be swung around the pivot pin 27 relative to the second arm 29 only in one direction separating the adjusting screw 30 from the knee part 29a of the second arm 29.

Such an angular displacement between the first and second arms 25 and 29 (which occurs when at least one coin remaining in the coin passageway hinders the descending movement of the coin rise preventing plate 18) is detected by a detecting switch 26 provided on the flank part of the first arm 25. This switch 26 is depressed by a switch actuating end 28 of the second arm 29 when the afore-mentioned angular displacement occurs.

On one hand, a cam follower 33 is provided on the other end of the second arm 29. The cam follower 33 is always in contact with the cam surface of the cam 37 and is displaced vertically.

The cam 37 is for height adjustment, and is fixedly mounted on a coin denomination setting shaft 36 which is driven through a pair of gears 35 and 35 by a coin denomination setting motor 34.

As shown in FIG. 3, as one example, a number of recesses 38 are formed around the periphery of the cam 37 in such a manner that the bottom of each recess 38 is spaced apart from the center of the cam 37 by a distance corresponding to the thickness of the coins to be processed.

On the coin denomination setting shaft 36, two cams 39 and 40 are also fixedly mounted for controlling the width of the coin passageway 3 in accordance with the diameter of the coins to be processed. Although it is not shown clearly in FIG. 2, each of the cams 39 and 40 is provided with recessed portions and projecting portions arranged alternately with an equal spacing therebetween.

The cam 39 is in contact with a cam follower 41 rotatably supported by a bracket 42 fixedly mounted on the movable base plate 10 on which the coin guide plate 6, coin classification plate 7, and a coin counting device (not shown) including a coin counting wheel 8 are mounted.

On the other hand, the other cam 40 is in contact with a cam follower 43 rotatably supported by a bracket 44 which is in turn fixedly mounted on the slidingly movable guide bar 11a. On the slidingly movable guide bar 11a is secured the movable base plate 10a on which the coin guide plate 6a and the coin classification plate 7a are fixedly mounted.

The operation of the first embodiment of the present invention will now be described in detail.

A plurality of push buttons each corresponding to a different denomination of coins are provided on a machine operating panel, these parts not being indicated in the drawing. When any one of the push buttons, corresponding to a denomination of coins to be processed is depressed, the aforementioned coin denomination setting motor 34 is energized. Then the denomination setting shaft 36 fixedly supporting the cams 37, 39, and 40 is rotated by the motor 34 through gears 35 and 35 until desired cam surface portions of the cams 37, 39, and 40 are in contact with the cam followers 33, 41, and 43, respectively.

The passage-width adjusting cam 39 thus displaces the movable base plate 10 through the cam follower 41 and the bracket 42, thereby bringing the coin guide plate 6 and the coin classification plate 7 to the positions corresponding to the diameter of coins to be processed. Likewise, the other passage-width adjusting cam 40 displaces the slidable guide bar 11*a* through the cam follower 43 and the bracket 44, thereby moving the movable base plate 10*a* secured to the slidable guide bar 11*a*, and the coin guide plate 6*a* and the coin classification plate 7*a* both mounted on the movable base plate 10*a* to their corresponding positions. The movements of the movable base plates 10 and 10*a* allow the width of the coin passageway 3 to be adjusted in accordance with the diameter of coins of the selected denomination.

At the same time, the height adjusting cam 37 is rotated to a position corresponding to the thickness of coins of the selected denomination, and displaces the cam follower 33 and the second arm 29 in accordance therewith. Owing to the unidirectionally swingable coupling made up of the pivot pin 27, adjusting screw 30, and the tension spring 32, the first arm 25 and the secnd arm 29 are rotated around the pivotal point 20 as if the two arms 25 and 29 were a unitary member.

Thus, the supporting plate 19 integral with the first arm 25 is rotated around the pivot pin 20, and the coin rise preventing plate 18 secured to the supporting plate 19 is brought into a position corresponding to the thickness of the coins now to be processed. Because of the unidirectionally swingable coupling comprising the pivot pin 20, adjusting screw 21, and the compression spring 23, the supporting frame 15 is also rotated around the pivot pin 20 as if the supporting frame 15 were integral with the supporting plate 19. The coin propelling belt 13 is thus displaced to a position corresponding to the thickness of the coins now to be processed.

In the case where any coin or coins are remaining in the coin passageway 3, when a push button (not shown) corresponding to the denomination of the coins is depressed as described hereinbefore, the coin classification driving motor 34 is energized, and the cams 37, 39, and 40 are rotated through the denomination setting shaft 36. When the cam follower 33 starts to ride on a projecting portion of the height adjusting cam 37 shown in FIG. 3, that is, before the coin guide plates 6 and 6*a* and the coin classification plates 7 and 7*a* are displaced to the new positions for the diameter of the coins now to be processed, the displacement of the second arm 29 to a lower position, as indicated by one-dot chain line in FIG. 2, caused by the cam follower riding on the projection cannot displace the first arm 25 because the coin rise preventing plate 18 abuts against the residual coins.

As a result, an angular, relative movement around the pivot pin 27 is caused between the first arm 25 and the second arm 29 in a direction separating the adjusting screw 30 on the first arm 25 from the knee part 29*a* of the second arm 29 against the force of the tension spring 32. This angular, relative movement causes the operating end 28 of the second arm 29 to operate the switch 26 secured to the first arm 25, thereby producing a detecting signal indicative of the existence of the residual coins in the coin passageway 3.

The coin detecting signal from the switch 26 is sent to the coin denomination setting motor 34 to stop the operation thereof.

Figure 4:
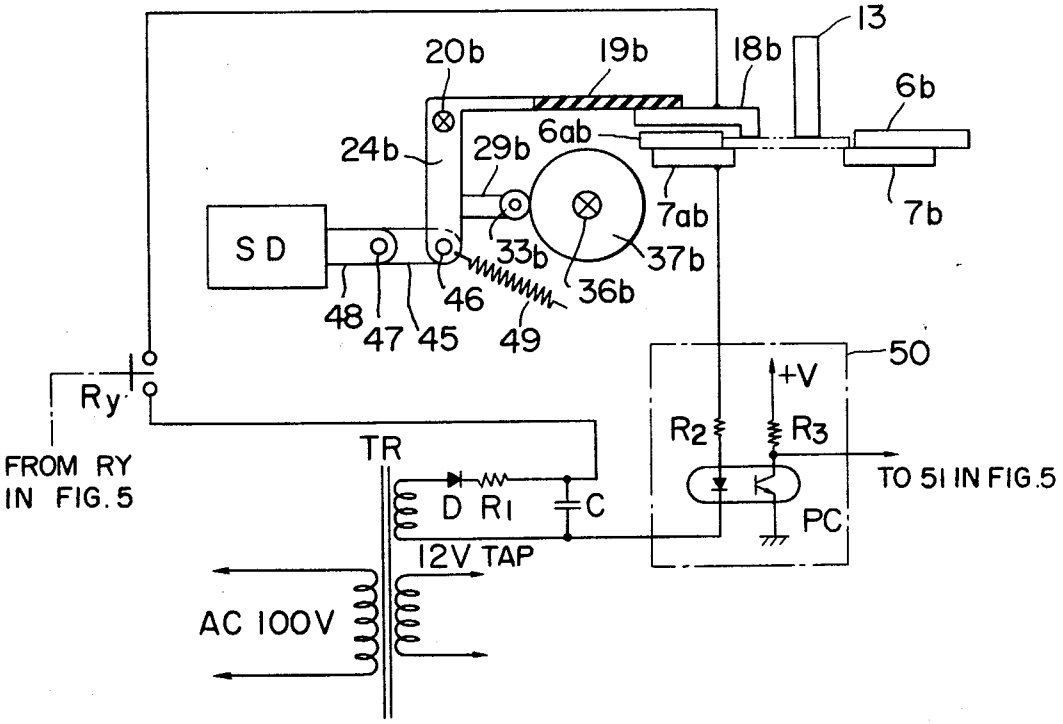
FIG. 4 is a schematic diagram showing an important part and also associated electrical circuits of a residual coin detecting device which constitutes a second embodiment of the invention.
Figure 5:
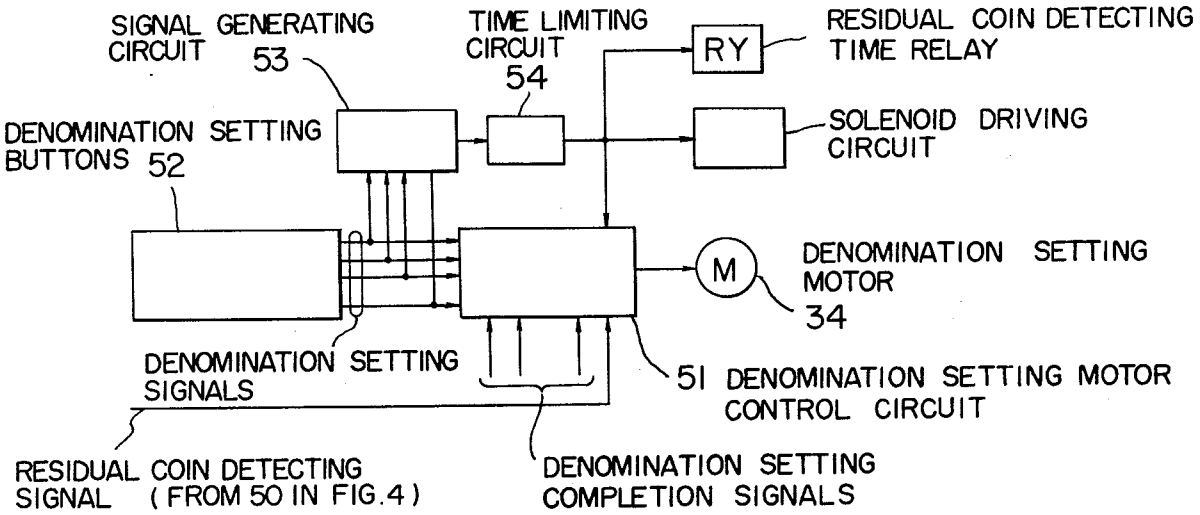
FIG. 5 is a block diagram showing an electrical control system for the second embodiment of the invention.

Referring to FIGS. 4 and 5, a second embodiment of the present invention will now be described in detail. In FIG. 4 those parts which are the same as or equivalent to corresponding parts in FIGS. 1, 2, and 3 are designated by like reference numerals with the addition of the suffix b.

The second embodiment of the invention will be described with attention being paid to those parts which are different from the first embodiment of the invention. A first end of a link 45 is connected to an end of a bracket 24*b* through a pin 46, and the other second end of the link 45 is connected through a pin 47 to a plunger or armature 48 of a solenoid (SD). A cam follower 33*b* at the tip of an arm 29*b* secured to an intermediate part of the bracket 24*b* abuts against a cam 37*b*.

One end of a spring 49 is secured to the aforementioned end of the bracket 24*b*, and the other end of the spring 49 is secured to the machine structure. With this arrangement, the spring 49 urges the cam follower 33*b* toward the surface of the cam 37*b* which is fixedly mounted on a shaft 36*b* coupled or interlinked with the shaft 36 in the first embodiment of the invention.

Although it is not indicated in FIG. 4, the mechanism comprising the members 14, 17, 15, 22, 23, and 21, all related to the coin propelling belt 13 in the first embodiment of the invention is desirably retained on the bracket 24*b* in the second embodiment. It will be apparent that the members 26, 29*a*, 30, 32, 27, 25*a*, and 29 used in the first embodiment of the invention are unnecessary in the second embodiment.

At the time a denomination of coins to be processed is set by a push button on the operating panel of the coin processing machine, the solenoid SD is energized by a signal delivered from a control system as shown in FIG. 5. Upon energization of the solenoid SD, the plunger 48 and the connecting link 45 are pulled leftwardly as viewed in FIG. 4, thereby rotating the bracket 24*b* around the pivot pin 20*b* in the counterclockwise direction against the force of the spring 49. The cam follower 33*b* is thus disengaged from the cam 37*b*, and a detecting member 18*b* (corresponding to the coin rise preventing member in the first embodiment of the invention) is lowered to an extremely lower position. When the solenoid is deenergized after a predetermined period as will be described hereinafter in detail, all the members are brought back to their original positions.

In FIG. 4, a supporting plate 19*b* secured to an end of the bracket 24*b* and supporting the detecting member 18*b* is made of an electrically insulating material. A coin guide plate 6*ab* and a coin classification plate 7*ab* corresponding to similar plates 6*a* and 7*a* in the first embodiment of the invention may be constructed and operated as in the first embodiment although they are not a part of the present invention.

A transformer TR provided therein has a primary winding to be connected to an a.c. 100 V line and a secondary winding provided with a tap, for instance, 12 V, and the like, adapted for supplying power to the coin processing apparatus. The a.c. 12 V tap voltage is rectified by a rectifying diode D, passed through a resistor $R_1$ protecting the diode D, and smoothed by a smoothing capacitor C thus being converted into a d.c. voltage.

A relay contact $R_y$ is closed in connection with the coin denomination setting operation as described hereinafter, thereby energizing the residual coin detecting circuit 50. A photocoupler PC is provided in the residual coin detecting circuit 50 for electrically separating the path of the coin detecting current flowing through the residual coins and the main body of the apparatus as hereinafter described from its control circuit, and thereby preventing the introduction of noise and the like from the main body of the machine and elsewhere to the control circuit. $R_2$ designates a resistor for limiting current flowing through a luminous diode provided in the photocoupler, and $R_3$ designates a load resistor of an output transistor in the photocoupler.

The operation of the second embodiment of the invention will now be described in detail.

The relay contact $R_y$ is opened during the normal operation of the coin processing machine except at the time of the coin denomination setting operation, whereby no current flows through the luminous diode during the normal operation, and the output transistor in the photocoupler PC is held in the OFF state. At this time, the output voltage of this residual coin detecting circuit is held substantially at +V.

When relay contact $R_y$ is closed during a denomination setting operation while no coin is remaining in the coin passageway, lowering of the detecting member **18*b* simultaneous with the closure of the relay contact $R_y$ as will be described hereinafter does not cause any short-circuit between the detecting member 18*b* and the coin classification plate *7ab*** by coins, and therefore no current flows through the luminous diode in the photocoupler PC. The output transistor in the photocoupler is thus held in OFF state and the output voltage of the transistor is held at +V.

In the case where one or more coins remain in the coin passageway at the time of coin denomination setting operation, this coin or coins establish an electric circuit passing through the thus lowered coin detecting member **18*b*, the coin or coins, and the coin classification plate *7ab*. Thus, an electric current flows through the luminous diode of the photocoupler PC, and the output transistor in the photocoupler is turned ON. Thus, the output voltage from the transistor becomes substantially 0, and a residual coin detecting signal is sent toward a denomination setting motor control circuit 51 in a control system the electric connection of which is shown in FIG. 5** in the form of a block diagram.

In this control system, the output from any one of the coin denomination setting buttons 52 is applied to the denomination setting motor control circuit 51 and also to a denomination setting signal generating circuit 53. The signal generating circuit 53, upon reception of the output from the button, generates an electric pulse signal which is sent to a time limit circuit 54. Upon reception of the electric pulse signal, the time limit circuit 54 delivers an electric signal of a predetermined duration which operates the solenoid SD through a driving unit and also a relay RY for closing the relay contact $R_y$ for the predetermined time period. Thus, the residual coin detecting member **18*b* and the residual coin detecting circuit 50 are operated as described above, and either one of the signals indicating the presence or absence of a residual coin or coins in the coin passageway is sent to the denomination setting motor control circuit 51**.

In the case where the output signal from the residual coin detecting circuit 50 indicates the absence of such coins, the denomination setting motor 34 is energized after the termination of the predetermined period of the time limiting circuit 54 until the completion of the denomination setting operation is detected by a setting position detecting device (not shown).

When the output signal from the residual coin detecting circuit 50 indicates the presence of residual coins, the denomination setting motor is not energized even after the termination of the limited period of the time limiting circuit 54, and therefore the setting for the coin denomination is not realized.

When the residual coins are manually removed out of the coin passageway, the denomination setting motor can be started by the depression of any one of the coin denomination setting buttons.

As will be apparent from the above description, the residual coin detecting member may be driven by a selectively operable electric driving means, such as the aforementioned denomination setting motor 34, which functions doubly to drive the denomination setting mechanism as in the first embodiment of the invention, or otherwise the detecting member may be driven by a separate driving device such as the solenoid SD as in the second embodiment of the invention. In the latter case the residual coin detecting signal is used for starting the motor 34 for operating the denomination setting mechanism.

It will also be apparent that the invention is not necessarily limited to the above described first and second embodiments thereof, and various modifications and alternations may also be made without departing from the spirit of the invention. For instance a clutch mechanism may be provided between the shaft 36 and the driving motor 34 in the first embodiment of the invention, and the residual coin detecting signal may be used to control the clutch mechanism instead of the driving motor 34. Other than the stopping of the motor 34 as in the first embodiment of the invention or controlling the start of the same motor 34 as in the second embodiment, the residual coin detecting signal may also be used for energizing an alarm lamp or for sounding a buzzer. Alternatively, an automatically operable residual coin removing mechanism may be further provided, and the residual coin detecting signal may also be used for operating the coin removing mechanism.

Although the coin guide members on both sides of the coin passageway in the above described embodiments of the invention have been described as being controlled separately by different controlling members such as cams 39 and 40, it will be apparent that either one of the guide members may be made stationary, thus omitting the controlling member corresponding to that guide member, or both of the guide members may be controlled by a single control member provided commonly for such operations.

It will also be apparent that the push buttons provided in the coin denomination setting position of the machine may be replaced by a rotary type switch having a plurality of contacts, and that the invention may also be applied to a coin processing machine having a turntable and a coin passageway, both inclined relative to the base plate or floor.

Although the detecting member of this invention is also operable as a coin rise preventing member, it is apparent that a separate coin rise preventing member other than the detecting member may be provided.

We claim:

1. In a coin processing machine wherein coins to be processed are supplied onto a turntable and thereafter fed in succession through a coin passageway extending from the periphery of the turntable, in which machine the width of the coin passageway is defined by a pair of coin guides which can be adjusted in accordance with the diameter of the coins to be processed by moving at least one of the coin guides which is adjustable, and a control member is provided in engagement with the movable coin guide, the combination therewith of a residual coin detecting device comprising electrical driving means selectively operable for bringing said control member to a predetermined position for moving the adjustable coin guide in response to a signal from a coin denomination setting section of the machine and a residual coin detecting member movable vertically between the coin guides prior to the movement of said movable coin guide by said electrical driving means thereby detecting any coin or coins which might be remaining in the coin passageway by the vertical movement of the coin detecting member.

2. A residual coin detecting device as set forth in claim 1 wherein said selectively operable electric driving means is an electric motor.

3. A residual coin detecting device as set forth in claim 1 wherein said control member is a cam engaging said at least one movable coin guide and is operated by said electrical driving means.

4. A residual coin detecting device as set forth in claim 1 wherein a second control member also operated by said electrical driving means is further provided for operating said detecting member.

5. A residual coin detecting device as set forth in claim 4 wherein said detecting member is moved vertically by said second control member through pivotally connected first and second members pivotally rotatable relative to each other only in one direction.

6. A residual coin detecting device as set forth in claim 5 wherein a switch is further provided between said first and second members and is operated by an angular displacement between the first and second members caused by coins remaining in the coin passageway.

7. A residual coin detecting device as set forth in claim 4 wherein said second control member driven by said electrical driving means has a first portion for driving said detecting member vertically between said coin guides and a second portion for adjusting said detecting member thereafter to a position corresponding to the thickness of coins to be processed in the coin processing machine.

8. A residual coin detecting device as set forth in claim 4 wherein said second control member driven by said electric driving means has only a portion for controlling said detecting member in accordance with the thickness of coins to be processed, and a separate actuating means for actuating said detecting member prior to the operation of said electrical driving means to move vertically between the coin guides is further provided in the coin detecting device.

9. A residual coin detecting device as set forth in claim 8 wherein aid separate activating means is a solenoid device.

10. A residual coin detecting device as set forth in claim 8 wherein a control circuit is further provided for operating said electrical driving means in response to a signal from the coin denomination setting section of the machine and also for preventing the initiation of the operation of the electric driving means when said control circuit receives a coin detecting signal from the recidual coin detecting member.

11. A residual coin detecting device as set forth in claim 8 wherein a time limiting circuit is further provided for operating said separate actuating means a predetermined period prior to the initiation of the operation of said electric driving means.

* * * * *